United States Patent [19]

Hodes

[11] 4,080,665

[45] Mar. 28, 1978

[54] COMBINATION TENNIS RACKET COVER AND CAP OR HAT

[76] Inventor: Morrie Hodes, Box 35161, Los Angeles, Calif. 90035

[21] Appl. No.: 731,721

[22] Filed: Oct. 12, 1976

[51] Int. Cl.[2] ..... A42B 1/06

[52] U.S. Cl. ..... 2/209.1; 273/74; 2/196

[58] Field of Search ..... 2/209.1, 196, 175, 199; 150/52 G; 273/74

[56] References Cited

U.S. PATENT DOCUMENTS

| | | | |
|---|---|---|---|
| 529,119 | 11/1894 | Frank | 2/196 |
| 2,007,235 | 7/1935 | Woodside | 2/196 |

FOREIGN PATENT DOCUMENTS

| | | | |
|---|---|---|---|
| 866,395 | 12/1952 | Netherlands | 2/209.1 |

*Primary Examiner*—Doris L. Troutman
*Attorney, Agent, or Firm*—Edward C. Walsh

[57] ABSTRACT

A tennis racket cover constructed of a fabric material or the like and having at least a partial peripheral zipper. One side of the cover is formed at least partially as a cap or hat. The cap or hat has a peripheral zipper for securing it to the other part of the cover. The one part of the cover may be formed as a cap with a crown and a bill or it may be formed as a hat with a crown and a brim. When formed either way, the cap or hat is provided with an adjustment as to size.

11 Claims, 9 Drawing Figures

Fig. 7
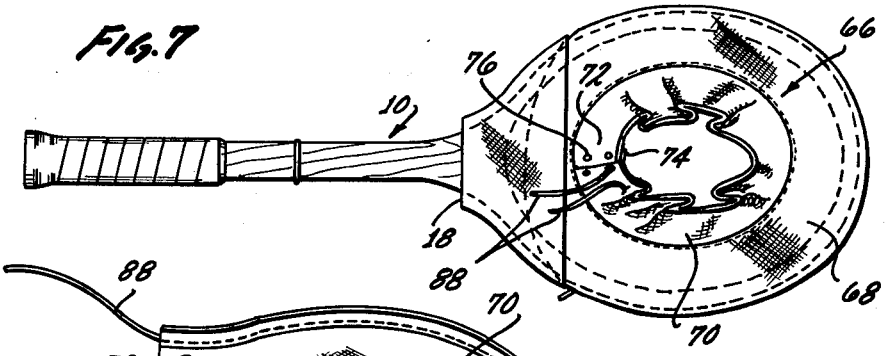
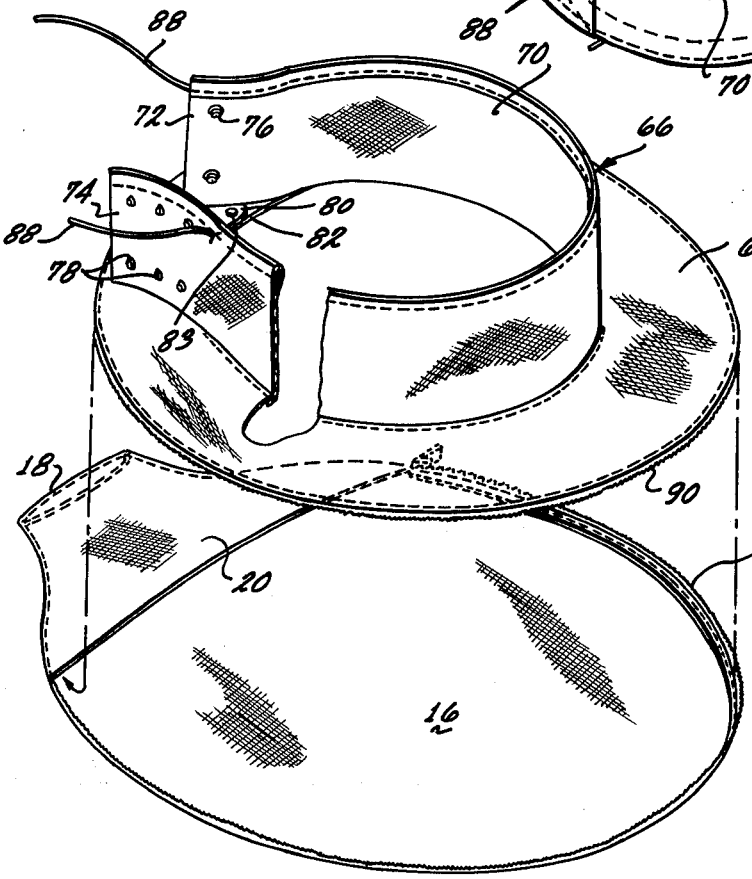
Fig. 8
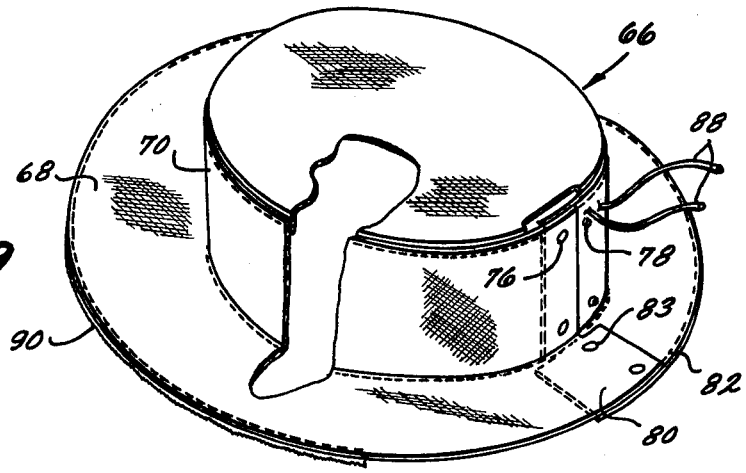
Fig. 9

COMBINATION TENNIS RACKET COVER AND CAP OR HAT

BACKGROUND OF THE INVENTION

1. Field of the Invention

The field of the invention is that of tennis racket covers and headwear including caps and hats. The invention is particularly concerned with a novel article which is a combination tennis racket cover and cap or hat.

2. Description of the Prior Art

Tennis racket covers which enclose the head of the racket with the handle passing through an opening are, of course, well known in the art. Various types of caps and hats are, of course, also well known. The combination of the herein invention, that is, a combined tennis racket cover and cap or hat is considered to be entirely unique.

SUMMARY OF THE INVENTION

The invention is a combined tennis racket cover and cap or hat as identified in the abstract.

In a preferred exemplary form of the invention, as described in detail hereinafter, a tennis racket cover is formed in two parts, including a first part which partially covers the racket and a second part which can be secured to the first part by suitable means such as a zipper, the second part, when removed, constituting either a cap or a hat. As used herein the terms "cap" and "hat" are used alternatively to denote the second part of the combination whether it actually is formed as a cap or a hat. In the exemplary form of the invention the second part is formed as a cap having a bill and crown constructed to partially cover one side of the racket, the bill having securement means preferably in the form of a zipper for securement to the first part of the cover.

In the second form of the invention the second part of the article is formed specifically as a hat having a crown and a brim, a zipper being provided at least partially around the periphery of the brim for securing it to the first part of the cover. Adjustments for head size are provided both when the second part of the article is formed as a cap and when formed as a hat. The cap or hat may, of course, be termed simply an article of headgear or headwear.

In the light of the foregoing, the primary object is to make available a completely new and unique article which is a combination tennis racket cover and cap or hat.

A further object of the invention is to realize the purpose or end that the user need only detach a part of the tennis racket cover from it to be provided with a hat or cap suitable for play.

A further object is to realize a combination article as in the foregoing wherein the article is formed of a first part of a fabric or similar material shaped to cover one side of a racket and part of the other side and a second part formed as a cap with securement means for securing it to the first part in a position to cover the other side of the racket not covered by the first part of the article.

A further object is to realize a combined article as in the foregoing wherein the second part is a hat with a crown and a brim.

Further objects and additional advantages of the invention will become apparent from the following detailed description and annexed drawings.

BRIEF DESCRIPTION OF THE DRAWINGS

FIG. 7 is a plan view of a modified form of the invention, showing it in position covering a typical tennis racket;

FIG. 8 is an exploded view showing the parts of the article of FIG. 7;

FIG. 9 is an isometric view of the hat of FIGS. 7 and 8.

DESCRIPTION OF THE PREFERRED EMBODIMENTS

Figure 1:
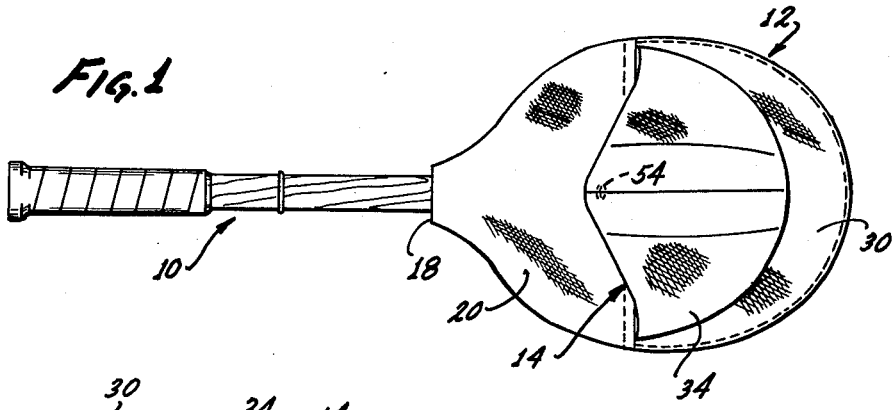
FIG. 1 is a view of a preferred form of the invention enclosing a typical tennis racket.
Figure 2:
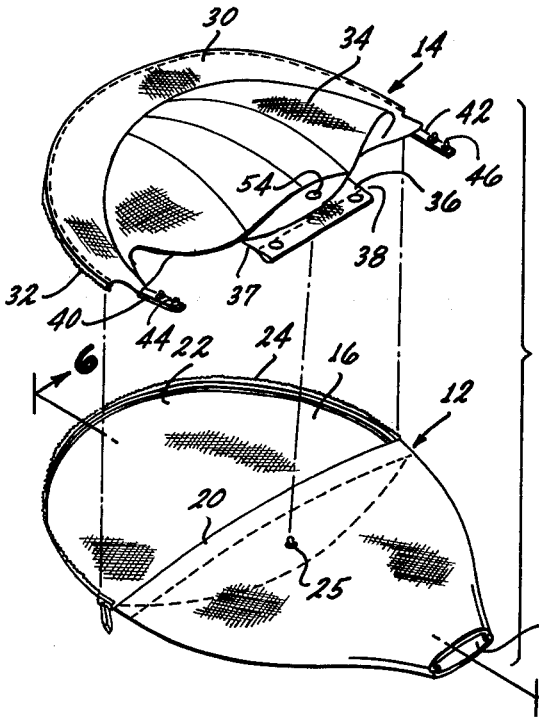
FIG. 2 is an exploded view showing the two parts of the combined article of FIG. 1.
Figure 3:
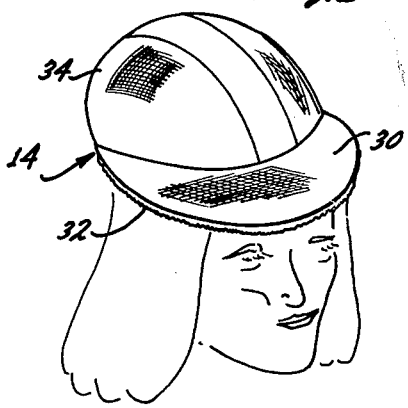
FIG. 3 is a view showing the second part of the combined article, that is the cap.
Figure 4:
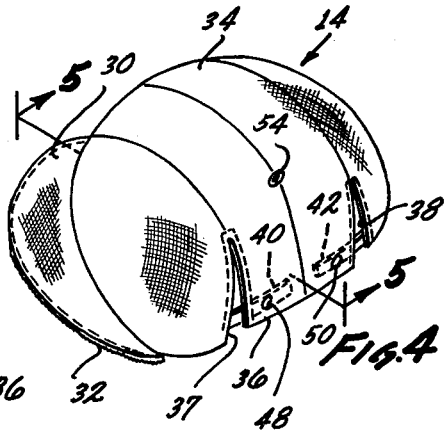
FIG. 4 is a rear isometric view of a cap of FIG. 3.

Referring now to FIG. 1, numeral 10 designates a typical tennis racket enclosed in a preferred form of the article of the invention, that is the cover as designated at 12, the cover having a part combined with it which forms a cap as identified at 14 in FIGS. 2, 3, 4, and 5.

The article has a lower part 16 which may be made of a suitable fabric material such as canvas or otherwise and having a shape conforming to the outline of the racket with an opening at one end for the handle of the racket as designated at 18. In the form of the invention as shown, the part as identified at 16 includes an integral section partially covering the other side of the racket as designated at 20 and which cooperates to provide the opening 18. The forward section of the part 16 of the article is designated at 22 and around its periphery there is provided a zipper element 24. Numeral 25 designates the male part of a snap fastener which cooperates with another part of a snap fastener as will be referred to presently.

The tennis racket cover is completed as an enclosure by attachment of second part identified at 14 which is formed as a cap. It may be formed of the same material as the part 16. It has a relatively stiff arcuate bill as designated at 30 around the periphery of which is a zipper element 32 adapted to cooperate with the element 24. It has a crushable crown part 34 at the rear part of which is flap 36, there being hemmed slits as designated at 37 an 38 between the flap part 36 and the remaining part of the crown 34. At the ends of the bill 32 are strips 40 and 42, each carrying two male snap fastener parts as designated at 44 and 46. On the inside of the flap 46 are provided female parts of snap fasteners as designated at 48 and 50. These may be provided in pairs to cooperate with the snap fastener parts 44 and 46 to provide an adjustment for head size.

At the back of the crown is a female snap fastener part 54 which can cooperate with the snap fastener part 25 previously described when the second part of the article, that is the cap, is secured to the other part with the crown of the cap collapsed with the flap 36 and with the portions of the crown adjacent to the slits 37 and 38 folded inwardly.

Figure 5:
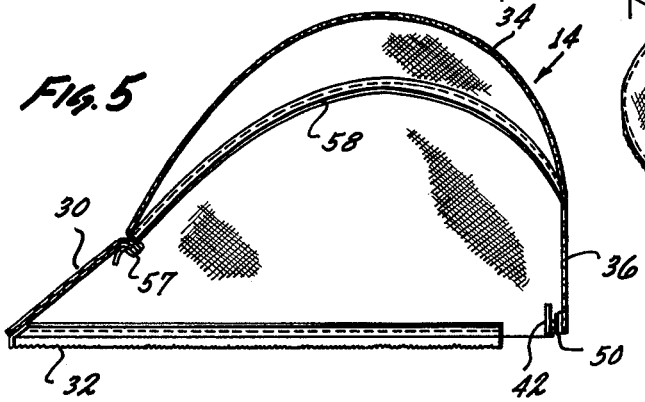
FIG. 5 is a cross-sectional view of the cap.

In FIG. 5, numeral 57 designates the seam and cloth band where the crown is secured to the bill 30, and numeral 58 designates one of the seams in the crown between joined sectors of the material of the crown.

Figure 6:
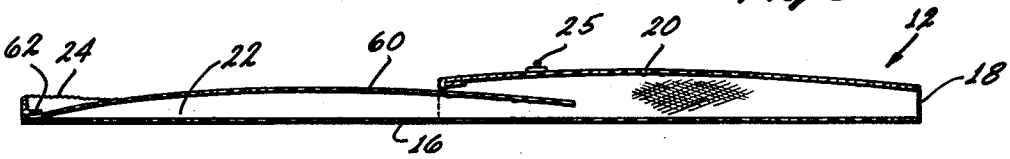
FIG. 6 is a cross-sectional view taken along the line 6—6 of FIG. 2.

Referring to FIG. 6, numeral 60 designates a layer or flap of fabric material the forward edge of which as designated at 62 is attached by seaming or the like to the fabric material constituting the first part of the article, this flap of material having a length so that its other end part can be inserted underneath the cover part 20 as shown in FIG. 6 so as to prevent the cap part from coming in direct contact with the springs of the racket when the cap may be moist with sweat or the like.

FIGS. 7, 8 and 9 show another form of the invention which is a combination tennis racket cover and hat which may be a hat with a crown and a brim. The crown may either be open as shown in FIG. 8 or covered as shown in FIG. 9. The first part of the racket is shaped to conform to the shape of the racket head, this part being designated at 16 and having a peripheral zipper member 24 as in the previous embodiment. A section of this part is attached to it and positioned to overlie the other side of the racket as shown in FIG. 8 to provide the opening 18 for the handle. The piece of material 60 as described in connection with the previous embodiment can be included if desired.

The second part as designated at 66 forms a hat with a relatively stiff brim 68 and a crown designated at 70 upstanding from the brim. The parts may be made from suitable fabric or similar material.

The crown is essentially a flat strip of material having end parts as designated at 72 and 74. These end parts carry parts of snap fasteners as designated at 76 and 78 for fastening the ends together. Preferably there are two of the snap fastener parts at one end and a group of six fastener parts at the other end 74 in spaced relationship in order to provide a suitable head adjustment. The brim 68 is essentially a ring shaped piece having an opening to accommodate the user's head and having end parts 80 and 82, each of these ends carrying snap fastener parts which can be snapped together to secure these ends together, one of these snap fastener parts being designated at 83.

In the construction of FIG. 8 a draw string 88 is provided which passes through a tunnel formed at the top edge of the crown 70, the purpose of the draw string being to be able to collapse the crown to a flat condition as illustrated in FIG. 7. The draw string 88 is similarly provided in FIG. 9 where the top of the crown is closed.

Around the periphery of the brim 68 is a zipper element 90 which cooperates with the zipper 24 on the part 16. Preferably the zipper securement extends around that portion corresponding to the section of part 16, not covered by the overlying layer member 20.

From the foregoing those skilled in the art will readily understand the nature of the invention and its unique characteristics and the capabilities that it offers to the user. The combined article is capable of serving as a tennis racket cover in the usual manner as illustrated in FIGS. 1 and 7. By merely unzipping the part which forms the cap or hat and removing it the user is provided with either a cap or hat suitable for play. The combination constitutes a single article but yet has all of the utility and conveniences of both a tennis racket cover and a cap or hat, in either alternative an adjustment being provided for head size.

The foregoing disclosure is representative of the preferred forms of the invention and is to be interpreted in an illustrative rather than a limiting sense, the invention to be accorded the full scope of the claims appended hereto.

What is claimed is:

1. A combination tennis racket cover and article of headwear comprising a first part and a second part, means for separably attaching the first part and second part together, the parts having a construction and shape such that when attached together they form a tennis racket cover having an opening for the handle of the racket to extend through, one of the parts being constructed to form an article of headwear and to be usable as such when separated from the other part.

2. A combination as in claim 1, wherein said one part is constructed to be collapsible into a flat condition when the parts are attached together.

3. An article as in claim 1, including zipper means carried by the said parts for attaching them together.

4. A combination as in claim 1, wherein said first part includes a section configurated to accommodate one side of a tennis racket having a second section positioned to accommodate the opposite side of the tennis racket.

5. A combination as in claim 4, wherein the said second part is configurated to accommodate and cover the part of the tennis racket not covered by the first part.

6. A combination as in claim 1, wherein the said one part is constructed as a cap having a visor and having a crown part, the parts having attachment means including zipper elements for attaching them together.

7. A combination as in claim 6, including additional attachment means for attaching the crown part of the cap to the other part of the article.

8. A combination as in claim 1, wherein said one part is constructed as a hat having a brim and having a crown part and zipper means whereby the brim of the hat is attachable to the said first part of the article.

9. An article as in claim 6, including means embodied in the cap providing an adjustment for head size.

10. A combination as in claim 8, including means providing an adjustment in the hat for head size.

11. A combination as in claim 10, the crown of the hat embodying means including a draw string adapted for collapsing the crown of the hat.

* * * * *